US006722105B2

(12) United States Patent
Jenkins et al.

(10) Patent No.: US 6,722,105 B2
(45) Date of Patent: Apr. 20, 2004

(54) METHOD OF MAKING AN INFLATABLE GAS BAG FOR USE AS A BOREHOLE PLUG

(75) Inventors: Sanford S. Jenkins, Lee's Summit, MO (US); Thomas S. Jenkins, Lee's Summit, MO (US); Geoffrey R. Robbins, Pymble (AU)

(73) Assignee: Stemlock, Incorporated, Lee's Summit, MO (US)

( * ) Notice: Subject to any disclaimer, the term of this patent is extended or adjusted under 35 U.S.C. 154(b) by 0 days.

(21) Appl. No.: 10/393,326

(22) Filed: Mar. 20, 2003

(65) Prior Publication Data

US 2003/0177932 A1 Sep. 25, 2003

Related U.S. Application Data

(62) Division of application No. 09/950,986, filed on Sep. 12, 2001, now Pat. No. 6,619,387.

(51) Int. Cl.[7] ..... B65B 1/04
(52) U.S. Cl. ..... 53/449
(58) Field of Search ..... 53/469, 474, 449

(56) References Cited

U.S. PATENT DOCUMENTS 4,846,278 A 7/1989 Robbins

*Primary Examiner*—David Bagnell
*Assistant Examiner*—Matthew J Smith
(74) *Attorney, Agent, or Firm*—Shock, Hardy & Bacon LLP

(57) ABSTRACT

A method for making a chemically inflatable gas bag using technical grade acetic acid, water, and sodium bicarbonate is provided. The method includes pouring diluted acetic acid into an HDPE bag, putting sodium bicarbonate into a PVA bag, sealing these bags, and placing these bags within a nylon/PE bag. The method further includes folding the gas bag in such a manner so that it easily inflates and completely seals the borehole.

5 Claims, 2 Drawing Sheets

METHOD OF MAKING AN INFLATABLE GAS BAG FOR USE AS A BOREHOLE PLUG

CROSS-REFERENCE TO RELATED APPLICATIONS

This is a divisional application of application Ser. No. 09/950,986, filed Sep. 12, 2001 now Pat. No. 6619387, issued Sep. 16, 2003 and entitled AN INFLATABLE GAS BAG FOR USE AS A BOREHOLE PLUG.

STATEMENT REGARDING FEDERALLY SPONSORED RESEARCH OR DEVELOPMENT

Not Applicable.

BACKGROUND OF THE INVENTION

The present invention relates to mining. More specifically, the present invention relates to a self-inflating borehole plug for use in sealing an explosive column.

Typically, boreholes are dug and used as explosive columns. Detonation of a typical, full column confined charge produces a single high amplitude stress wave that crushes the borehole wall and moves out into the surrounding rock producing a crack mechanism. In conjunction with the stress wave, high temperature gases assist in extending the crack formation and moving the rock mass of the ground and sublayers.

By incorporating an air gap (air deck) above, below, or within the explosive column, shock wave reflections within the borehole produce a secondary stress wave. This wave extends the crack formation before gas pressurization. The reduced borehole pressure caused by the air column reduces excessive crushing of the rock adjacent to the borehole wall but still is capable of extending the crack formation and moving the rock out away from the opening of the hole. Air deck volumes of up to about 50% can be used before there is any reduction in fragmentation. By using an air deck, smaller amounts of explosives may be used without much change in fragmentation.

Self-inflating plugs, such as gas bags, are used to seal boreholes at various depths. One disadvantage with gas bags currently available is that they leak over time and thus have a limited shelf life. Another problem with bags currently available is that precise amounts of acid are not used, thus causing variations in performance. In some cases, vinegar is used as the acid, and the concentration of acid in the vinegar is not always consistent. Still another disadvantage with currently available gas bags is that they are folded such that the folds sometimes prevent them from fully inflating and expanding.

In order to overcome these disadvantages, an improved gas bag is provided. This gas bag is able to fully expand to tightly fit within a borehole. It may further be used to create air decks of various volumes.

SUMMARY OF THE INVENTION

It is an object of the present invention to provide a gas bag that is folded in a way that can easily inflate completely and seal the borehole.

It is another object of the present invention to provide an inflatable gas bag that is durable so that it has a longer shelf life than conventional bags.

It is a further object of the present invention to provide a method of making the inflatable gas bag of the present invention.

According to the present invention, the foregoing and other objects are achieved by a chemically inflated gas bag that includes a high density polyethylene (HDPE) bag that contains acetic acid, a polyvinyl alcohol (PVA) water soluble bag that contains sodium bicarbonate, and a nylon/polyethylene (PE) bag wherein the HDPE bag and the PVA bag are contained within the nylon/PE bag. Another aspect of the present invention is a method of making this gas bag. This method includes pouring diluted acetic acid into an HDPE bag and sealing said HDPE bag, putting sodium bicarbonate in a PVA bag, sealing the PVA bag, and placing the PVA bag and the HDPE bag within a nylon/PE bag. The gas bag is folded in such a manner as to easily inflate. Still another aspect of the present invention involves using this gas bag by lowering it into a borehole before or as it inflates.

Additional objects, advantages, and novel features of the invention will be set forth in the description that follows and in part will become apparent to those skilled in the art upon examination of the following, or may be learned by practice of the invention.

BRIEF DESCRIPTION OF THE DRAWINGS

In the accompanying drawings, which form a part of the specification and are to be read in conjunction therewith, and in which like reference numerals are used to indicate like parts in the various views.

DETAILED DESCRIPTION OF THE PREFERRED EMBODIMENT

Figure 1:
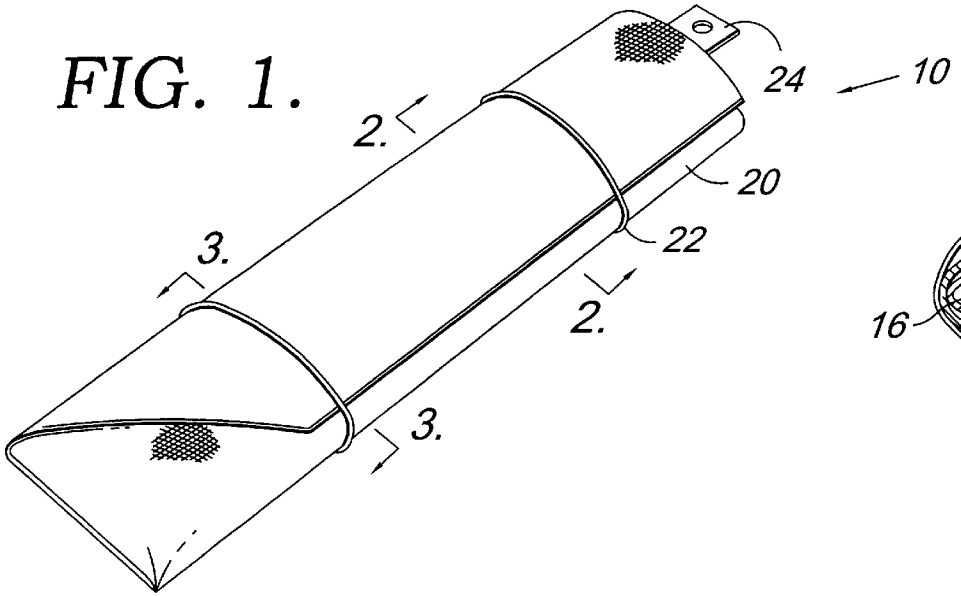
FIG. 1 is a perspective view of the gas bag of a preferred embodiment of the present invention.
Figure 2:
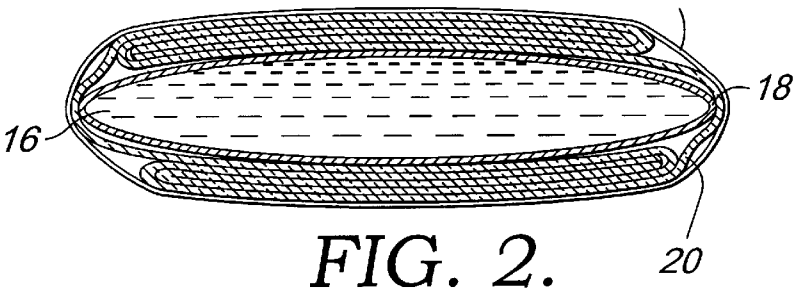
FIG. 2 is a cross-sectional view of the gas bag of FIG. 1 taken along line 2—2.
Figure 3:
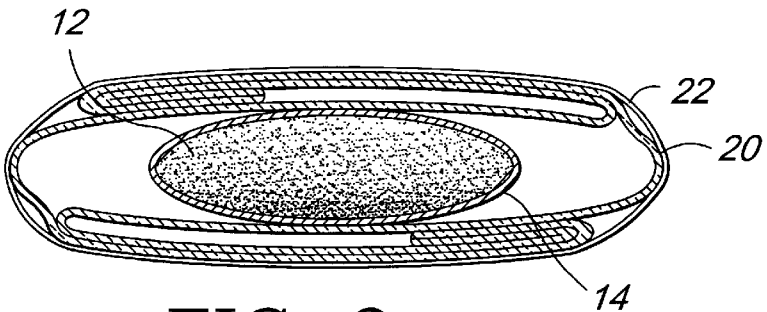
FIG. 3 is a cross-sectional view of the gas bag of FIG. 1 taken along line 3—3.

A device embodying the principles of this invention is shown in FIG. 1 and is broadly designated by the reference numeral 10. Gas bag 10 typically comprises sodium bicarbonate 12 contained within a PVA bag 14, as shown in FIG. 3, and acetic acid 16 contained within an HDPE bag 18, as shown in FIG. 2. Both the PVA bag 14 and the HDPE bag 18 are contained within a nylon/PE bag 20 which is folded and bundled together by bands 22. Tab 24 is coupled with nylon/PE bag 20.

Figure 5:
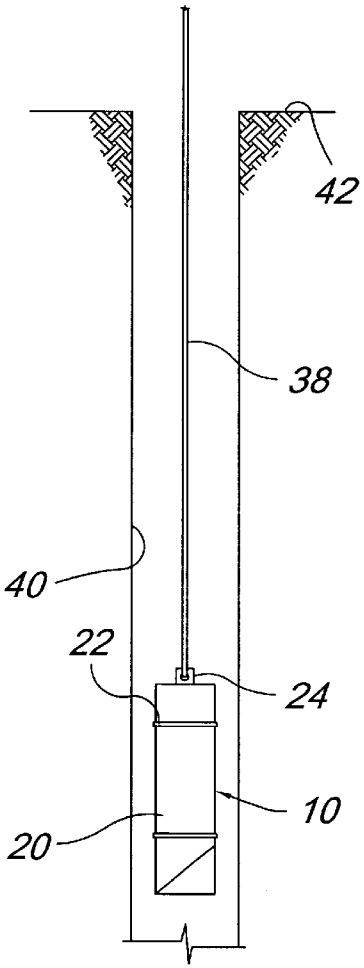
FIG. 5 is a schematic illustration of use of the gas bag in a borehole in a preferred embodiment of the present invention.
Figure 4:
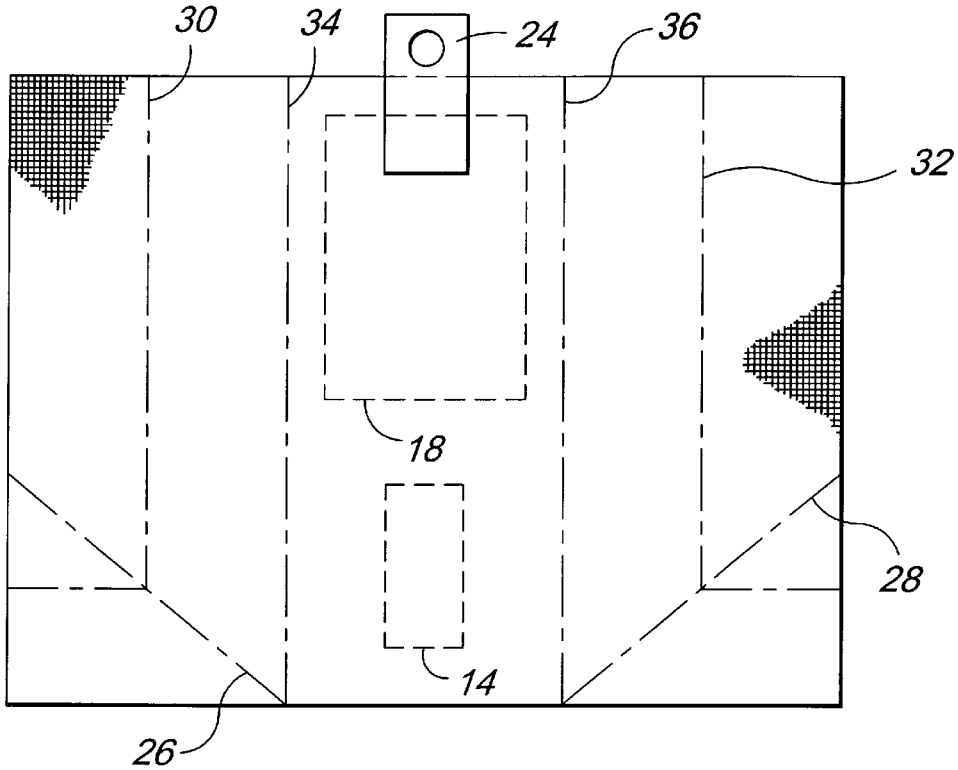
FIG. 4 is an elevational view of the gas bag shown in FIG. 1 with the nylon/PE bag unfolded and the folds indicated by dotted lines.

Gas bag 10 is constructed by securing the HDPE bag 18 to one end of nylon/PE bag 20 and placing the PVA bag 14 at the other end. As shown in FIGS. 1, 4, and 5, a tab 24 is secured to gas bag 10 for lowering the bag into a borehole. Referring to FIG. 4, a fold in nylon/PE bag 20 is made inwardly along a dotted line 26, and a fold is made outwardly along a dotted line 28. Next, a fold is made inwardly along a dotted line 30, and a fold is made outwardly along a dotted line 32. Following this, a fold is made inwardly along a dotted line 34, and a fold is made outwardly along a dotted line 36. The folded gas bag 10 is then secured with bands 22. Bands 22 may be, but are not limited to, rubber bands, strings, or tape. The gas bag has a shelf life of over about one year. In the preferred embodiment of the present invention, the gas bag has a shelf life of about 2–3 years.

The gas bag 10 is used by securing a line 38 to tab 24 and lowering the bag into a borehole 40 below the ground 42, as shown in FIG. 5. The gas bag can be placed at various depths in borehole 40, as discussed infra.

The acetic acid 16 is less corrosive than many other acids. Preferably, technical grade acetic acid is used. By using technical grade acetic acid, the reaction with the sodium bicarbonate has increased reliability and control. The acetic acid should be diluted with water to between about 8–30% by volume acetic acid. Preferably, the acetic acid is diluted to about 10–20% by volume acetic acid. Most preferably, the acetic acid is diluted to about 12–20% by volume acetic acid. If a 20 inch by 24 inch nylon/PE bag or smaller is used, then most preferably, the solution is about 12% volume per solution volume (v/v) acetic acid. If a 20 inch by 26 inch bag or similar sized bag is used, then most preferably, the solution is about 16% v/v acetic acid. If a 26 inch by 32 inch nylon/PE bag or larger is used, then most preferably, the solution is about 20% v/v acetic acid.

A high density polyethylene (HDPE) bag is used to hold the acetic acid. This bag should be substantially impervious to acetic acid vapors and water. It may be comprised of any material that can act as a barrier to the acid. Preferably, it is comprised of fluorinated polyethylene. Preferably, the bottom side of the HDPE bag has a weak heat seal so that when the bag is broken the acetic acid exits through the bottom side and is directed to flow onto the sodium bicarbonate. Most preferably, the HDPE bag is contained within a second bag that is not shown. This bag may be made of a water/acetic acid substantially impervious material such as PE or HDPE. The bag has small holes in its bottom side so that when the weak heat seal of the HDPE bag breaks, the small holes of the second bag control the flow of acetic acid onto the sodium bicarbonate creating a delay mechanism while the gas bag is lowered into a borehole. The acid slowly drips onto the sodium bicarbonate controlling the generation of carbon dioxide.

The sodium bicarbonate usually is in powder or tablet form. It reacts with the acetic acid to generate carbon dioxide gas and inflate nylon/PE bag 20. The amount of inflation is controlled by the amount of acetic acid released because acetic acid is the limiting reagent.

Polyvinyl alcohol (PVA) bag 14 may be used to hold the sodium bicarbonate. It should be water soluble. It is an optional component of gas bag 10. Alternatively, the sodium bicarbonate can merely be contained loose in nylon/PE bag 20. Preferably, the PVA bag is modified PVA such that it does not hydrolyze under alkaline conditions and thus has an improved shelf life. Most preferably, the acetate groups of the PVA are replaced so as to make the bag stay soluble under alkaline conditions and so as to prevent hydrolysis of the bag as quickly. The PVA bag begins to dissolve when acetic acid contacts it. It provides a delay means by creating a barrier that slows the contact of the acetic acid and the sodium bicarbonate.

Nylon/PE bag 20 includes one or more layers of nylon and one or more layers of PE. Each layer of the bag can be a PE/nylon/PE layer or a nylon/PE layer. The nylon acts as a vapor barrier and prevents the bag 20 from stretching when it inflates. The PE allows the bag to be sealed and therefore must be the most inner layer of bag 20. Other materials that are $CO_2$ barriers may also be used as bag 20.

Preferably, bag 20 is contained within a woven polypropylene outer container (not shown), and tab 24 is attached to this outer container. The woven polypropylene layer acts as an abrasion and puncture barrier. It is folded with bag 20, so that both are folded together in the S-fold configuration that is discussed in further detail infra. Preferably, the woven polypropylene layer and bag 20 are substantially clear so that the acetic acid and sodium bicarbonate can be viewed to determine if the HDPE bag has broken and the reaction has started. Also, preferably, the woven polypropylene has 10–12 strands per inch.

The nylon/PE bag 20 is substantially gas-tight and is of a shape such that it can be dropped or lowered into a borehole. The nylon bag will not develop weak spots when folded for long periods of time or when inflated. Weak spots do not develop in the nylon bag from inflation because the bag does not stretch. It is preferred that the gas bag is able to withstand at least about 20 psi internal pressure and is able to maintain that pressure for up to about four weeks.

The fold lines need not be in the particular places that are shown in FIG. 4. More generally, the folds may be as follows: The bottom corner of the first side of bag 20 is folded diagonally inward and the bottom corner of the second side of bag 20 is folded diagonally outward. A first side edge of bag 20 is folded inwardly along a first line substantially parallel to the first side edge of gas bag 20, and a second side edge of bag 20 is folded outwardly along a second line substantially parallel to the first line. The first side is folded inwardly along a third line substantially parallel to the first line and between the first line and the second line, and the second side is folded outwardly along a fourth line substantially parallel to the second line and between the second line and the third line. Preferably, none of the lines intersects the HDPE bag. This S-type folding configuration allows the bag to unfold easily as it is inflated. This configuration also provides better borehole sealing because the gas bag fully expands and inflates. Still further, this configuration funnels all of the sodium bicarbonate to the bottom center of the bag by having diagonally folded corners that prevent it from spreading throughout the bottom of the bag. In addition, in this configuration, the acetic acid is channeled toward the sodium bicarbonate. The S-type folding configuration also is an effective configuration for storing the gas bag because it provides extra layers of nylon/PE and woven polypropylene around the reagents so as to prevent them from reacting prematurely.

The inflation of the gas bag is achieved by a chemical reaction of the acetic acid and the sodium bicarbonate which results in the evolution of carbon dioxide gas. More specifically, the acetic acid is contained in an HDPE bag so that it does not inadvertently mix with the sodium bicarbonate but is capable of being mixed when so required. The acetic acid is contained within an HDPE bag so as to keep it separated from the sodium bicarbonate until the bag is activated by breaking, popping, or puncturing the HDPE bag. Upon activation, all of the acid in the HDPE bag is released onto the sodium bicarbonate. Delay means in the gas bag provide a sufficient time interval between release of the acetic acid and the generation of carbon dioxide gas so as to permit the gas bag to be dropped or lowered down a borehole to a preselected position. This delay may be accomplished by a system which allows the acid to drip slowly onto sodium bicarbonate, as discussed above.

Boreholes are drilled so that an explosive charge may be delivered to an underground earth structure. Gas bags may be placed at selected depths in a borehole so as to form air decks. The gas bag or borehole plug can be dropped or lowered down a borehole to a preselected position since the extent of the gas-producing chemical reaction is able to be delayed following initiation of mixing of co-reagents.

In use, the acetic acid is caused to commence diffusion towards the sodium bicarbonate. The gas bag is placed in a borehole and lowered down into the borehole to a preselected position. The acetic acid is allowed to mix with the sodium bicarbonate so as to generate carbon dioxide gas, gas generation continues within the gas bag of the present invention to form an inflated borehole plug firmly associated with and in contact with the borehole wall. Preferably, following this, an explosive is lowered down the borehole and placed on the inflated borehole plug.

Alternatively, the gas bag may be lowered down into the borehole to a preselected position before the acetic acid and sodium bicarbonate are brought together for reaction to form a gas to inflate the gas bag.

In still another alternative, after bringing the reagents together, the gas bag may be dropped down a borehole so that the device falls under the force of gravity. The gas inflates the device during falling whereby the diameter of the device reaches a size comparable to the diameter of the borehole at a preselected position. This causes the device to locate at the preselected position and form a decking plug at this position.

The gas bag of the present invention also can be used to cap a borehole at the time of drilling or to protect it from rain. Such capping avoids use of waterproof explosives and prevents water damage or backfilling of the borehole. The cap can be burst to load a borehole with explosives. In addition, the bottom of a borehole can be sealed by placing a gas bag at the bottom of the hole at the time of drilling so as to prevent water from flowing into the borehole. Still further, an inflated gas bag may be positioned on top of water in the bottom of the borehole. Then, an explosive may be placed on the gas bag. Also, an inflated gas bag may be positioned above an explosive column in a borehole so as to provide an air column.

The following are examples of various gas bags and methods of making these gas bags that are within the scope of this invention. These examples are not meant in any way to limit the scope of this invention.

EXAMPLE 1

A gas bag of the present invention was made as follows: Sodium bicarbonate powder was placed in a PVA bag, and then the bag was sealed. Technical grade acetic acid was diluted with water to 16% v/v and was poured into an HDPE bag. The HDPE bag was sealed and secured within a 20 inch by 26 inch nylon/PE bag. The PVA bag was secured at the opposite end of the nylon/PE bag from the HDPE bag. The bag was folded as described above. The folded bag was secured with rubber bands.

EXAMPLE 2

A gas bag of the present invention was made as follows: Sodium bicarbonate tablets were placed in a modified PVA bag, and then the bag was sealed. Technical grade acetic acid was diluted with water to 20% v/v and was poured into an HDPE bag. The HDPE bag was sealed and secured within a 26 inch by 32 inch nylon/PE bag. The modified PVA bag was secured at the opposite end of the nylon/PE bag from the HDPE bag. The bag was folded as described above. The folded bag was secured with strings.

EXAMPLE 3

A gas bag of the present invention was made as follows: Sodium bicarbonate powder was placed in a modified PVA bag, and then the bag was sealed. Acetic acid was diluted with water to 12% v/v and was poured into an HDPE bag. The HDPE bag was sealed and secured within a 20 inch by 24 inch nylon/PE bag. The PVA bag was secured at the opposite end of the nylon/PE bag from the HDPE bag. The bag was folded as described above. The folded bag was secured with tape.

EXAMPLE 4

A gas bag of the present invention was made as follows: Acetic acid was diluted with water to 18% v/v and was poured into an HDPE bag. The HDPE bag was sealed and secured within a 20 inch by 26 inch nylon/PE bag. Sodium bicarbonate tablets were also placed in the nylon/PE bag away from the HDPE bag. The bag was folded as described above, and the tablets were at the end where the diagonal folds were located. The folded bag was secured with rubber bands.

From the foregoing, it will be seen that this invention is one well adapted to attain all the ends and objects herein above set forth together with other advantages which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

We claim:

1. A method for making a chemically inflatable gas bag using technical grade acetic acid, water, and sodium bicarbonate, comprising:

diluting said acetic acid with water;

providing an HDPE bag;

pouring said diluted acetic acid into said HDPE bag;

sealing said HDPE bag wherein said diluted acetic acid is contained;

providing a PVA bag that is modified so as not to hydrolyze under alkaline conditions;

putting said sodium bicarbonate in said PVA bag;

sealing said PVA bag wherein said sodium bicarbonate is contained;

providing a nylon/PE bag; and placing said PVA soluble bag and said HDPE bag within said nylon/PE bag.

2. The method of claim 1, wherein said acetic acid is diluted with water to between about 8 and 30% v/v acetic acid.

3. The method of claim 1, wherein said acetic acid is diluted with water to between about 12 and 20% v/v acetic acid.

4. The method of claim 1, further comprising:

providing a bag that is substantially impervious to water and acetic acid with small holes therein, and placing said HDPE bag within said bag with holes before placing said HDPE bag within said nylon/PE bag.

5. The method of claim 1, wherein said nylon/PE bag has a first side, a second side, a top side, a bottom side, a first side edge, a second side edge, and two bottom corners, said method further comprising:

folding the bottom corner of said first side diagonally inward;

folding the bottom corner of said second side diagonally outward;

folding said first side edge inwardly along a first line substantially parallel to said first side edge of said gas bag;

folding said second side edge outwardly along a second line substantially parallel to the first line;

folding said first side inwardly along a third line substantially parallel to said first line and between said first line and said second line; and folding said second side outwardly along a fourth line substantially parallel to said second line and between said second line and said third line.

* * * * *